United States Patent [19]

Ilitch

[11] Patent Number: 4,913,340

[45] Date of Patent: Apr. 3, 1990

[54] TRAY FOR CARRYING FOOD

[75] Inventor: Michael Ilitch, Bloomfield Hills, Mich.

[73] Assignee: Little Caesar Enterprises, Inc., Farmington Hills, Mich.

[21] Appl. No.: 258,374

[22] Filed: Oct. 17, 1988

[51] Int. Cl.[4] ..... B65D 5/26; B65D 5/30

[52] U.S. Cl. ..... 229/143; 229/149; 229/906; 229/915

[58] Field of Search ..... 229/143, 149, 906, 918; 426/128

[56] References Cited

U.S. PATENT DOCUMENTS

| | | | |
|---|---|---|---|
| 655,939 | 8/1900 | Overton | 229/149 X |
| 2,793,801 | 5/1957 | Papadopoulos | 229/143 X |
| 3,637,404 | 1/1972 | MacManus | 426/128 X |
| 3,650,383 | 3/1972 | Nigro | 426/128 X |
| 3,871,570 | 3/1975 | Garmon | 229/149 X |
| 4,082,215 | 4/1978 | Eichenauer | 229/143 X |
| 4,141,447 | 3/1979 | Anderson | 206/392 |
| 4,260,060 | 4/1981 | Faller | 229/906 X |
| 4,301,960 | 11/1981 | Alexander et al. | 229/906 X |
| 4,349,147 | 9/1982 | Jensen | 229/143 X |
| 4,385,721 | 5/1983 | Olsen et al. | 229/143 X |
| 4,418,863 | 12/1983 | Kimbrell, Sr. | 229/143 X |
| 4,498,586 | 3/1985 | Vitale | 426/128 X |
| 4,537,344 | 8/1985 | Thomas | 229/143 X |
| 4,700,843 | 10/1987 | Cohen | 229/906 X |
| 4,702,409 | 10/1987 | Osborne | 229/143 X |
| 4,765,534 | 8/1988 | Zion et al. | 229/149 X |

FOREIGN PATENT DOCUMENTS

| | | | |
|---|---|---|---|
| 1551240 | 8/1979 | United Kingdom | 229/143 |
| 2076782 | 12/1981 | United Kingdom | 229/149 |

*Primary Examiner*—Stephen Marcus
*Assistant Examiner*—Jes F. Pascua
*Attorney, Agent, or Firm*—Brooks & Kushman

[57] ABSTRACT

A tray for carrying food is disclosed as being constructed from a paperboard blank (12) having a central panel (14) of a rectangular shape with side portions (16, 17) and end portions (18, 19). A mid portion (20) is located therebetween. After assembly of the tray, side panels (22, 24) and end panels (30, 32) are folded upwardly from the central panel (14) about scoreline connections (26, 28–34, 36). A pair of horizontally extending roof panels (38, 40) overlie the central panel (14) in a horizontally spaced relationship to economize on the amount of paperboard needed for assembly of the tray and allow moisture to escape from the food. To provide rigidity to the tray and stability to a stack of multiple trays while preventing contact between food and the next highest tray in a stack, a retainer (46) extends upwardly from each corner of the central panel (14). Each retainer (46) comprises a pair of vertically spaced corners (48, 50). Located in the middle portion of the central panel (14) is a pair of interlocking tabs (52, 54) which are positionable generally perpendicularly above the central panel (14) to provide horizontal separation between food in the tray and a spaced vertical relationship between the food and the central panel of the next highest tray in a stack of trays.

13 Claims, 3 Drawing Sheets

TRAY FOR CARRYING FOOD

TECHNICAL FIELD

This invention relates to a carryout food tray for use with pizza, but can also be utilized with other edibles, such as carryout foods.

BACKGROUND ART

Convenience foods such as pizzas, donuts, and other bakery goods which are sold for carryout use are traditionally packaged in paperboard containers. However, in some instances, the packages have little or no integrity and will often fail or collapse during transportation, thus spilling or otherwise damaging the packaged food products. For example, U.S. Pat. No. 4,301,960 discloses a package for food stuffs, but does not include end panels to restrain the pizza from falling out when the trays are inclined during transportation or use.

As is well known, carryout foods are packaged in a variety of ways for transportation by the customer from the point of sale to the eating place. For items such as pizza, one of the many varieties of packaging is a flat cardboard box having a hinged top which is swung open before serving the pizza. Such boxes have the attribute of minimizing contact between the box and the pizza top, but incur the disadvantages of being relatively costly and are cumbersome in use while serving food. Other approaches to selling pizza involve a flat cardboard tray which is inserted into a bag to cover the pizza. While this type of packaging is more economical than its cardboard counterpart, the flat tray does not prevent contact between the bag and the top of the pizza. Also, the pizza is not prevented from slipping off the flat tray during transportation or when it is inclined. For example, U.S. Pat. No. 4,494,689 discloses a carryout food tray in which end panels have rounded outer edges that facilitate insertion of the tray into a bag. However, this approach does not readily permit the stacking of trays one on top of the other in a stable fashion, nor does it minimize the amount of wasted paperboard.

DISCLOSURE OF INVENTION

An object of the present invention is to provide an improved carryout food tray that has particular utility in the pizza business, but can also be utilized with other carryout foods. In carrying out this object, the food tray of the present invention can be stored flat prior to assembly for use. In its assembled construction, the tray prevents contact between the top of food on the tray and either a bag into which the tray is inserted, or the bottom of an overlying tray in a stack of trays. As disclosed, the tray also allows convenient service of food from the tray, while preventing food from slipping off the tray upon inclination. Further, the device provides improved stability to each tray in a stack of trays. Also, the tray taught by the present invention includes a partially opened roof which minimizes unwanted paperboard stock and permits evaporation without condensation, thus allowing the food to avoid unwanted sogginess and stay fresh for longer periods.

The carryout food tray of the present invention is comprised of a paperboard blank having a central panel of a rectangular shape. Inside the periphery of the central panel are side and end portions, and a mid portion is located therebetween. A pair of side panels extend perpendicularly upwards from the central panel, each side panel having a foldable scoreline connection to the associated side portion of the central panel. To complete the lateral enclosure of, for example, one or more pizzas, a pair of end panels also extend perpendicularly upwards from the central panel, each end panel having a foldable scoreline connection to the associated end portion of the central panel. The side and end panels cooperate together to prevent food from slipping off the central panel when the tray is inclined. A pair of horizontally extending roof panels lie above the central panel. Each roof panel has a foldable scoreline connection to the associated side panel and overlies one of the side portions of the central panel in a horizontally spaced relationship to the other roof panel to minimize unwanted paperboard stock and to allow moisture to escape from the food. Extending upwardly from each corner of the central panel is a retainer comprising a pair of vertically spaced enclosed corners to provide rigidity to the tray and stability to a sack of multiple trays, while preventing contact between carryout food on each tray and the central panel of the next highest tray in the stack. Each vertically spaced enclosed corner is formed from one side panel, one associated end panel, and one associated roof panel or central panel.

In the preferred construction, the mid portion of the central panel includes a pair of interlocking tabs which are positionable generally perpendicularly above the central panel to provide horizontal separation between food, such as a pair of pizzas in the tray and a spaced vertical relationship between the food and the central panel of the next highest tray in a stack of trays.

As disclosed, each roof panel also has a pair of foldable end scoreline connections between the roof panel and the associated roof panel end to thereby allow each roof panel end to be folded downwardly over the associated end panel end. Each roof panel end includes a tab, and each end panel end includes a slot for receiving the tab on the adjacent roof panel end. In assembling the tray, each tab is folded inwardly through and around each slot after the side and end panels are folded upwardly to thereby secure the roof panels to the associated end panels, thus imparting rigidity to each tray and stability to a stack of trays.

Each roof panel includes an inwardly curving concave edge, thus providing ease of access to the food and allowing improved evaporation of moisture from the food, thereby allowing the food to stay fresh while avoiding unwanted sogginess in storage and transit.

To allow for economies in manufacturing each tray, the length of the central panel parallel to the side panels is approximately equal to the length of each side panel, so that when the paperboard blank is cut prior to assembling the tray, unwanted paperboard is minimized.

The objects, features, and advantages of the present invention are readily apparent from the following detailed description of the best mode for carrying out the invention when taken in connection with the accompanying drawings.

BEST MODE FOR CARRYING OUT THE INVENTION

Figure 4:
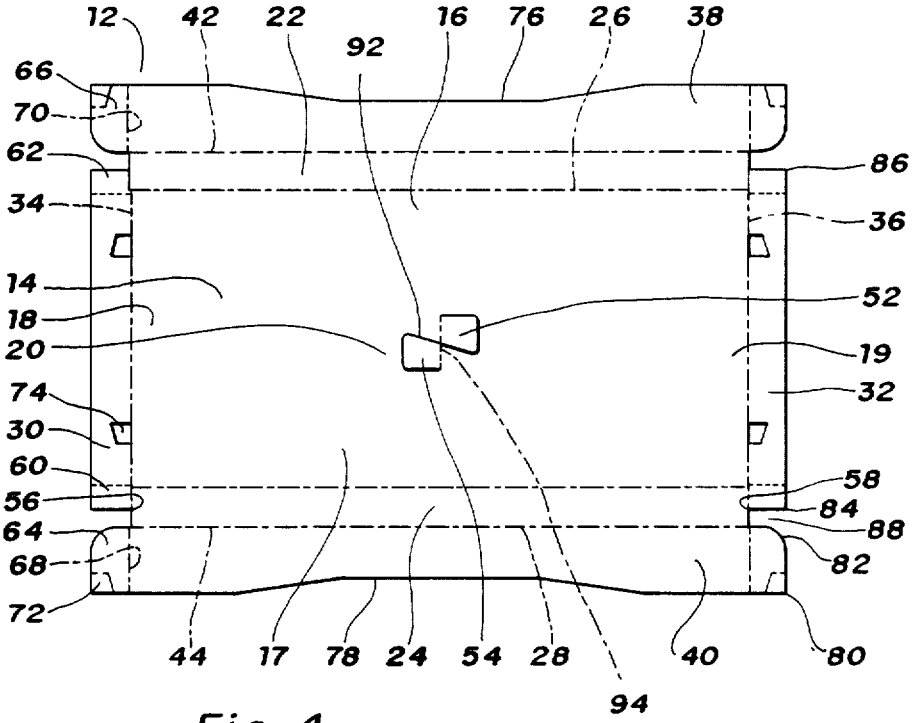
FIG. 4 is a plan view of a carryout tray prior to assembly.
Figure 5:
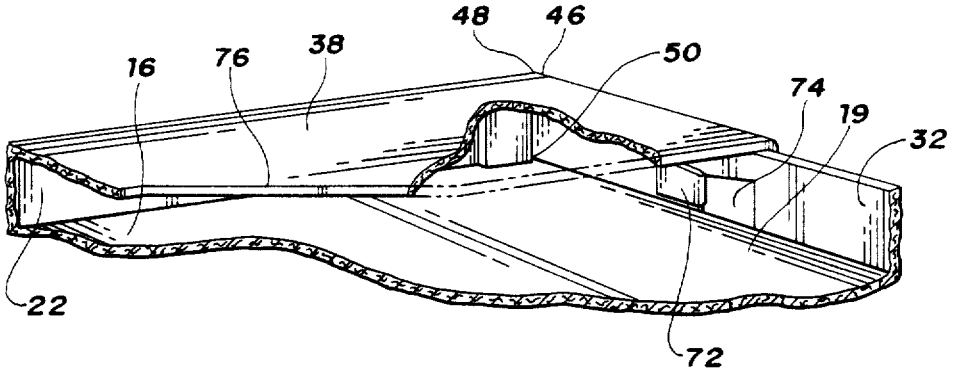
FIG. 5 is an enlarged, partially sectioned, perspective view of one corner of the carryout tray constructed in accordance with the present invention.

With reference to the drawings, a carryout food tray 10 constructed in accordance with the present invention is comprised of a paperboard blank 12. The tray 10 may be constructed from any foldable flat sheet material such as cardboard, plastic-coated cardboard, or the like. The paperboard blank 12 is illustrated in FIG. 4 in its flat condition and is foldable as is hereinafter more fully described to an assembled condition in order to permit carrying of food on the tray from the store for consumption.

Figure 1:
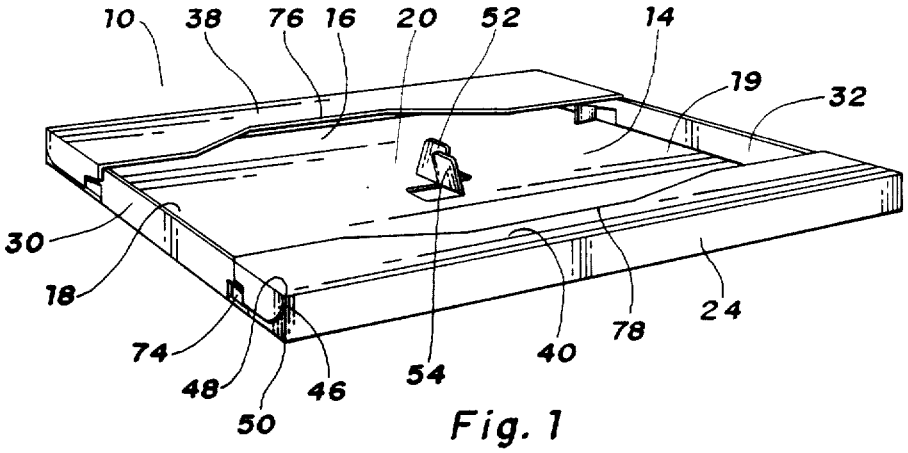
FIG. 1 is a perspective view of a carryout tray constructed in accordance with the present invention.
Figure 2:
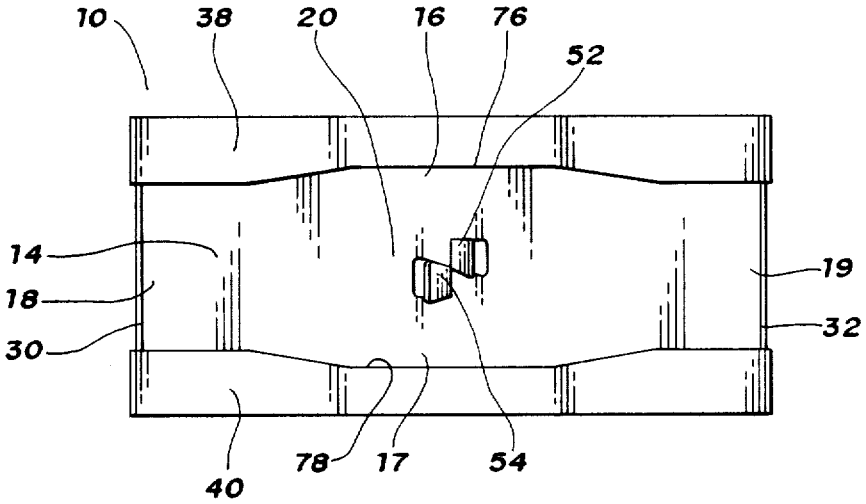
FIG. 2 is a top view of a carryout tray constructed in accordance with the present invention.
Figure 3:
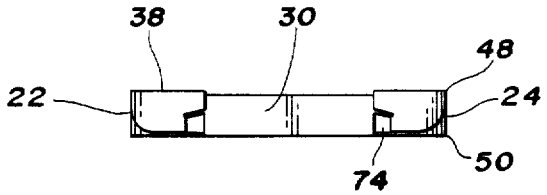
FIG. 3 is an end view of a carryout tray constructed in accordance with the present invention.

With reference to the drawings and more particularly to FIGS. 1–3, there is depicted a tray 10 for carrying food, such as a pair of pizzas. The tray 10 comprises a paperboard blank 12 having a central panel 14 of a rectangular shape with side portions 16, 17 and end portions 18, 19, with a mid portion 20 located therebetween. Extending perpendicularly upwards from the central panel 14 is a pair of side panels 22, 24. Each side panel has a foldable scoreline connection 26, 28 to the associated side portion 16, 17 of the central panel 14. A pair of end panels 30, 32 also extend perpendicularly upwards from the central panel 14. Each end panel 30, 32 has a foldable scoreline connection 34, 36 to the associated end portion 18, 19 of the central panel 14. In use, the side panels 22, 24 and end panels 30, 32 prevent food from slipping off the central panel 14 when the tray 10 is inclined.

A pair of roof panels 38, 40 extend horizontally above the side portions 16, 17 of the central panel 14. Each roof panel 38, 40 has a foldable side scoreline connection 42, 44 to the associated side panel 22, 24. The roof panels 38, 40 lie in a horizontally spaced relationship to each other, thereby allowing moisture to escape from the food while minimizing wasted paperboard when the blank is cut and assembled to form the tray 10.

A retainer 46 comprising a pair of vertically spaced corners 48, 50 extends upwardly from each corner of the central panel 14 to provide rigidity to the tray 10 and stability to a stack of multiple trays, while preventing contact between carryout food on each tray 10 and the central panel 14 of the next highest tray in the stack. Each vertically spaced enclosed corner is formed from one side panel, one associated end panel, and one associated roof panel or central panel.

Extending upwardly from the mid portion 20 of the central panel 14 is a pair of pop-up interlocking tabs 52, 54. These tabs 52, 54 are positionable generally perpendicularly above the central panel 14 to provide horizontal separation between food in the tray 10 and a spaced vertical relationship between the food and the central panel 14 of the next highest tray 10 in a stack of trays. As best shown in FIG. 4, the interlocking tabs 52, 54 include side portions from a common inclined scoreline 92 which is skewed with respect to the side 22, 24 and end 30, 32 panels. An orthogonal scoreline connection 94 lies between each tab 52, 54 and the central panel 14.

Continuing with the primary reference to FIG. 4, the side, end, and roof panels each have opposite ends 56, 58; 60, 62; 64, 66 which are positionable in a cooperating relationship with the ends of the adjacent panels to form the associated retainer 46. As best shown in FIG. 4, each roof panel 38, 40 also has a pair of foldable end scoreline connections 68, 70 between the roof panel and the associated roof panel end to thereby allow each roof panel end 64, 66 to be folded downwardly over the associated end panel end.

As best seen in FIG. 4, each roof panel end 64, 66 includes a tab 72 and each end panel end 60, 62 includes a slot 74 for receiving the tab 72 on the adjacent roof panel end. In use, each tab 72 is folded inwardly through and around each slot 74 after the side and end panels 22, 24; 30, 32 are folded upwardly to thereby secure the roof panels 38, 40 to the associated end panels, thus imparting rigidity to each tray 10 and stability to a stack of trays.

To allow moisture to evaporate and allow ready access to the carried food, each roof panel 38, 40 includes an inwardly curving concave edge 76, 78. As can best be seen in FIGS. 1–2, the length of the central panel 14 parallel to the side panels 22, 24 is approximately equal to the length of each side panel 22, 24, so that when the paperboard blank is cut prior to assembling the tray 10, unwanted paperboard is minimized. As is also evident from FIG. 4, each roof panel end includes a square roof panel corner 80 and a rounded roof panel corner 82 for ease of assembly, since there is minimal interference between the panels upon folding and sliding them cooperatively together. Each end panel end 60, 62 includes a pair of squared end panel corners 84, 86. One of the pairs of squared end panel corners 84 at each end panel end 60 and the rounded roof panel corner 82 of the adjacent roof panel end define therebetween a section 88 which is a small portion of the paperboard blank 12 to minimize unwanted construction material.

Figure 6:
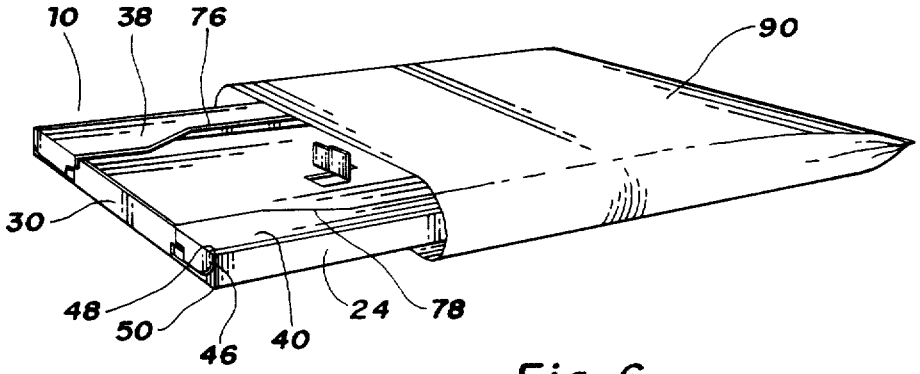
FIG. 6 is a perspective view of the carryout tray constructed in accordance with the present invention, partly enveloped by a bag.

As evident from FIG. 6, the loaded tray 10 can partially or completely be inserted in a cooperating outer bag 90.

After a tray 10 has been assembled as disclosed, there results a carryout food tray which can be produced with considerable manufacturing economies, since surplus paperboard material is minimized. Problems associated with stackability and unwanted contact between food and an overlying roof or tray are reduced because the tray is rigid, while its roof is sufficiently open to allow ready access to the food and permit evaporation.

While the best mode for carrying out the invention has been described in detail, those familiar with the art to which this invention relates will recognize various alternative designs and embodiments for practicing the invention as defined by the following claims.

What is claimed is:

1. A tray for carrying food comprising:

a paperboard blank including a central panel of a rectangular shape having side and end portions and a mid portion located between the side and end portions, the blank including a pair of side panels extending perpendicularly upwards from the central panel, each side panel having a foldable scoreline connection to the associated side portion of the central panel, and a pair of end panels extending perpendicularly upwards from the central panel, each end panel having a foldable scoreline connection to the associated end portion of the central panel, the side and end panels preventing food from slipping off the central panel when the tray is inclined, a pair of horizontally extending roof panels, each roof panel having a foldable side scoreline connection to an associated side panel, each roof panel overlying one of the side portions of the central panel and one of the end panels in a horizontally spaced relationship to the other roof panel to provide rigidity to the tray and to allow moisture to escape from the food, a pair of vertically spaced corners formed from associated side, end, and roof panels, each pair of vertically spaced cube corners extending from a corner of the central panel to provide further rigidity to the tray and stability to a stack of multiple trays, while preventing contact between carryout food on each tray and the central panel of the next highest tray in the stack and a pair of interlocking tabs located proximate the mid portion of the central panel which are positionable generally perpendicularly above the central panel extending upwardly therefrom a distance approximately equal to the height of each side and end panel to provide horizontal separation between food in the tray and a spaced vertical relationship between the food and the central panel of the next highest tray in a stack of trays.

2. The carryout food tray of claim 1 wherein the side, end, and roof panels each have opposite ends which are positionable in a cooperating relationship with the ends of the adjacent panels to form the associated pair of vertically spaced cube corners.

3. The carryout food tray of claim 2, each roof panel also having a pair of foldable end scoreline connections between the roof panel and the associated roof panel end to thereby allow each roof panel end to be folded downwardly into juxtaposition with the associated end panel.

4. The carryout food tray of claim 3, each roof panel end including a tab, each end panel including a slot for receiving the tab on the adjacent roof panel end, each tab being folded through and around each slot after the side and end panels are folded upwardly to thereby secure the roof panels to the associated end panels, thus imparting rigidity to each tray and stability to a stack of trays.

5. The carryout food tray of claim 2, wherein each roof panel end includes a squared roof panel corner and a rounded roof panel corner, the latter being proximate the associated end panel for ease of assembly, and each end panel includes a pair of squared end panel corners, one of the pair of squared end panel corners each end panel and the rounded roof panel corner of the adjacent roof panel end defining therebetween a section which is a small portion of the paperboard blank to minimize unwanted paperboard.

6. The carryout food tray of claim 1, each roof panel including an inwardly curving concave edge, thus providing ease of access to the food and allowing improved evaporation of moisture from the food, thereby allowing food to stay fresh while avoiding unwanted sogginess in storage and transit.

7. The carryout food tray of claim 1, wherein the length of the central panel parallel to the side panels is approximately equal to the length of each side panel, so that the paperboard blank can be cut with minimal waste.

8. The carryout food tray of claim 1 in combination with a bag which encloses a filled tray when the food is ready for delivery.

9. A tray for carrying food comprising:

a paperboard blank having a central panel of a rectangular shape having side and end portions and a mid portion located between the side and end portions, the blank including a pair of side panels extending perpendicularly upwards from the central panel, each side panel having a foldable scoreline connection to the associated side portion of the central panel, and a pair of end panels extending perpendicularly upwards from the central panel, each end panel having a foldable scoreline connection to the associated end portion of the central panel, the side and end panels preventing food from slipping off the central panel when the tray is inclined, a pair of horizontally extending roof panels, each roof panel having a foldable side scoreline connection to an associated side panel, each roof panel overlying one of the side portions of the central panel in a horizontally spaced relationship to the other roof panel to thereby allow moisture to escape from the food, a pair of vertically spaced corners extending upwardly from each corner of the central panel to provide rigidity to the tray and stability to a stack of multiple trays, while preventing contact between carryout food on each tray and the central panel of the next highest tray in the stack, and the mid portion of the central panel including a pair of interlocking tabs which are positionable generally perpendicularly above the central panel to provide horizontal separation between food in the tray and a spaced vertical relationship between the food and the central panel of the next highest tray in a stack of trays.

10. The carryout food tray of claim 1, the pair of interlocking tabs including side portions cut from a common inclined scoreline, the inclined scoreline being skewed with respect to the side and end panels.

11. The carrying out food tray of claim 12, wherein each tab in the pair of interlocking tabs is folded about a scoreline connection between each tab and the central panel, each tab being moved arcuately upwards through more than 90° about the associated scoreline connection so that upon release, the tabs engage each other in a back-to-back relationship, the pair of tabs essentially lying in a plane which is generally perpendicular to the central panel.

12. The carryout food tray of claim 1 wherein the length of each side panel is approximately equal to twice the length of each end panel so that the interlocking tabs divide the central panel into two approximately equal areas located on opposite sides of the mid-portion of the central panel in a horizontally spaced relationship.

13. The carryout food tray of claim 1, wherein the pair of interlocking tabs comprise tabs which are upwardly bendable in a first direction about substantially coaxial scoreline connections in said central panel, said tabs having yieldable portions which interfere when said tabs are upwardly bent in said first direction so that said pair of interlocking tabs remain upright and said tabs are prevented from bending opposite to said first direction.

* * * * *

UNITED STATES PATENT AND TRADEMARK OFFICE

CERTIFICATE OF CORRECTION

PATENT NO. : 4,913,340

DATED : April 3, 1990

INVENTOR(S) : Michael Ilitch

It is certified that error appears in the above-identified patent and that said Letters Patent is hereby corrected as shown below:

Column 2, Line 20, "sack" should be --stack--.

Column 5, Line 53, Claim 5, "corners" should be --corners at--.

Column 6, Line 43, Claim 11, "Claim 12" should be --Claim 10--.

Signed and Sealed this

Thirtieth Day of July, 1991

*Attest:*

*Attesting Officer*

HARRY F. MANBECK, JR.

*Commissioner of Patents and Trademarks*